US008028836B2

(12) United States Patent
Bacon

(10) Patent No.: US 8,028,836 B2
(45) Date of Patent: Oct. 4, 2011

(54) SYSTEM FOR PRODUCT PACKAGING AND DISPLAY

(75) Inventor: Thomas M. Bacon, Portland, OR (US)

(73) Assignee: VTech Telecommunications Ltd., Hong Kong (HK)

( * ) Notice: Subject to any disclaimer, the term of this patent is extended or adjusted under 35 U.S.C. 154(b) by 240 days.

(21) Appl. No.: 12/327,253

(22) Filed: Dec. 3, 2008

(65) Prior Publication Data

US 2009/0139896 A1 Jun. 4, 2009

Related U.S. Application Data

(60) Provisional application No. 60/992,215, filed on Dec. 4, 2007.

(51) Int. Cl.
*B65D 85/00* (2006.01)
*B65D 19/00* (2006.01)
*B65D 25/54* (2006.01)

(52) U.S. Cl. ..... 206/459.5; 206/386; 206/526; 206/769; 206/777; 206/778

(58) Field of Classification Search ..... 206/459.5, 206/461–462, 471, 526, 588, 589, 591–592, 206/764–769, 775–781, 386; 229/111–114, 229/162.1, 162.6
See application file for complete search history.

(56) References Cited

U.S. PATENT DOCUMENTS 2,125,833 A * 8/1938 Dowling ..... 206/459.5
2,286,879 A * 6/1942 Thew ..... 229/113
2,781,898 A * 2/1957 Desmond et al. ..... 206/775
2,993,587 A 7/1961 Stone et al.
3,298,504 A * 1/1967 Carter ..... 206/777
3,338,392 A * 8/1967 Newlin, Jr. et al. ..... 206/45.25
3,670,881 A 6/1972 Dutcher
3,776,375 A 12/1973 Rohdin
4,180,165 A 12/1979 Kuchenbecker
4,739,353 A 4/1988 Heuer et al.
4,848,577 A 7/1989 Hoffman et al.
(Continued)

FOREIGN PATENT DOCUMENTS

DE 80006903 3/1980
(Continued)

OTHER PUBLICATIONS

German Office Action with English Translation, dated Sep. 7, 2007.

*Primary Examiner* — Bryon Gehman
(74) *Attorney, Agent, or Firm* — McAndrews, Held & Malloy LLC

(57) ABSTRACT

A packaging assembly having an open design for displaying a product is provided. The packaging assembly is configured for storage and display in high density arrays of packaging assemblies, such as storage in pallets, and is configured to display visual information to a user from any perspective, even when the packaging assembly is packed in high density arrays of packaging assemblies. The packaging assembly includes an inner portion designed to contain a product and a housing designed to house the inner portion, wherein the inner portion includes a substantially transparent cover that facilitates display of the product. The packaging assembly includes an outer portion having a three dimensional window box frame, wherein portions of the window box frame are configured to couple to flanges provided on the inner portion.

20 Claims, 13 Drawing Sheets

U.S. PATENT DOCUMENTS

| | | | | |
|---|---|---|---|---|
| 5,582,293 | A * | 12/1996 | Kay | 206/775 |
| 5,871,099 | A | 2/1999 | Mellenthin et al. | |
| 5,979,662 | A | 11/1999 | Green | |
| 6,039,495 | A | 3/2000 | Zimmerman et al. | |
| 6,050,420 | A | 4/2000 | Green | |
| 6,152,305 | A | 11/2000 | Green | |
| 6,367,624 | B1 | 4/2002 | Szczepanski et al. | |
| 6,367,632 | B1 | 4/2002 | Green | |
| 6,401,932 | B1 * | 6/2002 | Weinstein et al. | 206/779 |
| 6,427,842 | B1 | 8/2002 | Green | |
| 6,581,777 | B2 | 6/2003 | Thibault | |
| 7,392,900 | B2 * | 7/2008 | Semel | 206/775 |
| 7,546,924 | B2 * | 6/2009 | Oliveira | 206/775 |
| 2006/0113215 | A1 | 6/2006 | Clements et al. | |
| 2007/0193922 | A1 | 8/2007 | Bacon et al. | |

FOREIGN PATENT DOCUMENTS

| | | |
|---|---|---|
| DE | 43 17 021 | 11/1994 |
| FR | 2 871 142 | 9/2005 |
| WO | WO 02/02420 | 10/2002 |

* cited by examiner

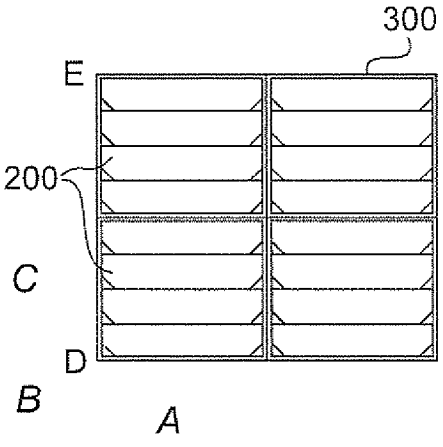
FIG. 5a
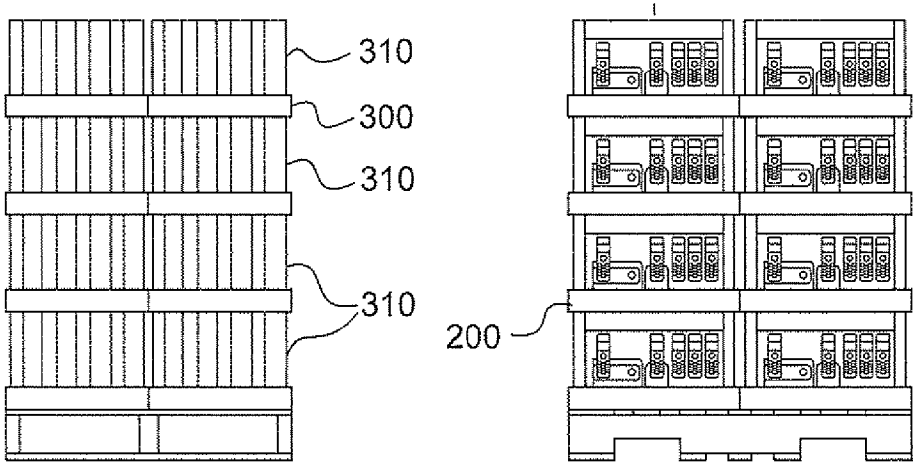
FIG. 5b
FIG. 5c
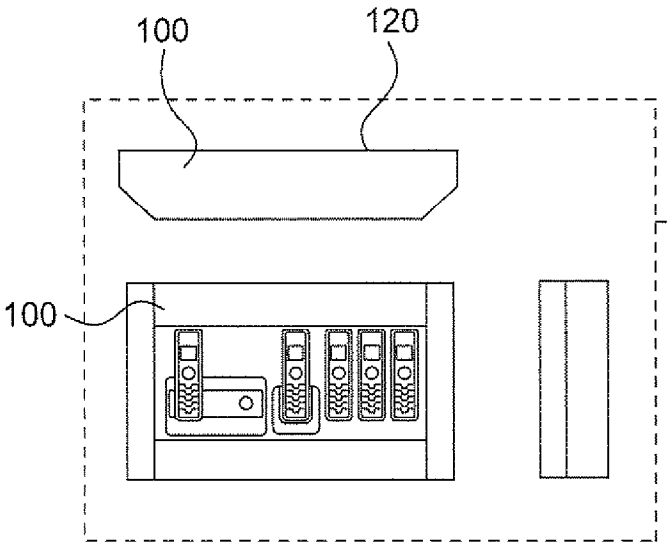
FIG. 4

SYSTEM FOR PRODUCT PACKAGING AND DISPLAY

This application claims priority to U.S. Provisional Patent Application No. 60/992,215, filed Dec. 4, 2007, which is incorporated by reference herein in its entirety.

BACKGROUND

1. Field of the Invention

The present invention relates to packaging assemblies for storage and display of products.

2. Background of the Invention

In the world of high volume retail selling, it is desirable to present products to a customer in an attractive way, while still being able to accommodate both a large variety of products, as well as a large number of units for any given product. Often, the need to catch a viewer's attention on the part of a manufacturer/retailer of a particular product may be compromised by the need to store and display products in a compact manner consistent with the high volume and generally low cost sales of the retailer. In addition, with respect to warehouse clubs in particular, there is a need for product packages that can be stacked on a pallet, moved as a unit to a sales location, and easily unwrapped for display to and access by customers.

In addition, the challenge for manufacturers of packages is in striking the appropriate balance between adequately protecting the products from damage and minimizing the amount of handling necessary to display the products on the store floor. Further complicating this balance, the manufacturers generally favor plastic individual product packaging, such as clamshell packages or blister packs, because it is inexpensive and deters theft. Plastic packaging has the additional benefit of enabling the actual product to be viewable by consumers. Such packaging, however, is more susceptible to shipping damage and more difficult to display in bulk form (e.g., typical clamshells were originally intended to hang and did not stand up on their own). As a result, manufacturers and warehouse clubs are in a constant search for packaging that ships and protects the inexpensive plastic individual product packaging, and allows for easy handling and display of the products on the store floor.

A packaging assembly aimed at meeting the guidelines of warehouse clubs is described in U.S. Pat. Nos. 5,979,662; 6,050,420; 6,152,305; 6,367,632; and 6,427,842. This assembly has two distinguishing features. First, it requires that the plastic individual product packaging provide the support that allows multiple assemblies to be stacked on top of each other. Second, it relies on pairs of slots in the side panels of the base of the assembly alone to hold the plastic individual product packaging in place.

In order for the individual product packaging to provide support for the assembly, it is desirable that the individual product packaging be strengthened beyond what is necessary to perform the functions of product protection, display, and theft deterrence. It is also desirable for a base to be strengthened beyond what is necessary to support and protect the assembly. Strengthening both the individual product packaging and the base of the assembly increases the overall cost and complexity of the packaging assembly. Accordingly, it can be appreciated that a substantial need exists for packaging assemblies that meet the guidelines of warehouse clubs, yet maintain the lowest overall increase in packaging costs and complexity.

SUMMARY OF THE INVENTION

In accordance with an aspect of the present invention, a packaging assembly having an open design for displaying a product is provided, wherein the packaging assembly is configured for storage and display in high density arrays of packaging assemblies, such as storage in pallets, and is configured to display visual information to a user from any perspective, even when the packaging assembly is packed in high density arrays of packaging assemblies.

The packaging assembly includes an inner portion designed to contain a product and a housing designed to house the inner portion, and having a shape configured to facilitate storage in densely packed arrays, such as on pallets, as well as to allow display of the product while housed in the package and stored in the densely packed array.

The packaging assembly housing can comprise a container having a set of mutually orthogonal panels that facilitate packing of a plurality of the packaging assemblies in a dense, two or three dimensional orthogonal array. In one embodiment, a pair of narrow chamfer portions is provided along two opposite edges of a front side of the housing. Accordingly, the packaging assembly can be conveniently placed into and removed from a densely packed array of assemblies by grasping a packaging assembly in the region of the chamfer.

The chamfer portions can be provided along opposite sides of the front side of the housing that are configured to be vertical when the packaging assembly is arranged for display, such as in a pallet.

Information, such as salient features of the product contained in the packaging assembly, can be included on the surface of each chamfer portion. Similar or identical information can be included along each of a pair of vertical chamfers.

Accordingly, even when stored in a pallet display having a two-package-wide dense-packed array of package assemblies, each package assembly is configured to provide useful information to a viewer, whether the viewer is directly in the front of the pallet or on either side of the pallet (e.g., approaching the pallet along an aisle in a store).

In one embodiment of the present invention, the front side of the housing comprises a pair of mutually parallel front panels that are substantially parallel to a back panel and are substantially orthogonal to a pair of side panels, as well as substantially orthogonal to a top panel and a bottom panel. The pair of front panels can comprise a top front and bottom front panel, each substantially opaque, which are disposed along respective top and bottom regions of the front side of the packaging assembly, such that the product is displayed in an open region having upper and lower boundaries defined by the top front and bottom front panels.

In another embodiment of the present invention, visual information is provided on each of a pair of side panels, a pair of chamfer portions, a top and bottom panel, and a rear panel. Accordingly, even when the packaging assembly is arranged in dense arrays on a pallet, a viewer is provided with product information when viewing the pallet from any direction.

In one embodiment of the present invention, the housing is configured to open up along at least one side, such that the inner portion containing the product can be slidably removed or inserted into the housing.

In accordance with an embodiment of the present invention, a method is provided for assembling a packaging assembly that includes a product insert and window frame portion designed to house the product insert, wherein the window frame portion comprises a unitary object, which, in a precursor state, has an initial substantially flat cross-type shape that comprises a central portion having four sides that form a substantially rectangular shape, wherein the central portion is configured to form a back portion of the window frame housing when fully assembled, first and second side portions being arranged on one side and another side, respectively, of a first pair of opposite sides of the central portion, wherein the first and second side portions are substantially similar to one another, and a top portion and bottom portion being that arranged on one side and another side, respectively, of a second pair of opposite sides of the central portion, wherein the product insert comprises a pair of flanges extending from mutually opposite first and a second sides of a base portion of the product insert. The method comprises assembling each of the first and second side portions and the bottom portion into three dimensional window frame portions that define three sides of a three dimensional window frame and an intermediate window region therebetween. The assembled first and second side portions each include a side panel arranged substantially perpendicular to the central portion, a chamfer panel adjacent to the side panel and forming an angle of about thirty to sixty degrees with respect to the side panel, an inner wall panel adjacent to the chamfer panel and arranged substantially parallel to the side panel, such that the inner wall panel extends from a front of the assembled housing toward the central portion, and a back panel adjacent to the inner wall panel and facing the central portion with its outer edge extended toward the side panel so as to hide the back panel. The method further comprises leaving the top portion in a substantially unassembled state, wherein the top portion is parallel to the central portion, arranging the product insert wherein the base is parallel to the central portion and top portion, and wherein the first and second sides are parallel to the first and second side portions of the window frame, folding the flanges of the product insert into a position that is substantially parallel to the central portion and sliding the insert over the substantially unassembled top portion into the intermediate window region, wherein the flanges are disposed between the back panels of the side portions and the central portion, and wherein a top portion of the product insert is disposed within the intermediate window region.

BRIEF DESCRIPTION OF THE DRAWINGS

The above-mentioned and other features and advantages of this disclosure, and the manner of attaining them, will become more apparent and the disclosure itself will be better understood by reference to the following description taken in conjunction with the accompanying drawings.

FIG. 4 is a schematic diagram illustrating top, front, and side views of the packaging assembly of FIG. 1.

FIG. 5*a* is a schematic diagram illustrating a top view of the packaging assembly pallet system of FIG. 3*a*.

FIG. 5*b* is a schematic diagram illustrating a side view of the packaging assembly pallet system of FIG. 3*a*.

FIG. 5*c* is a schematic diagram illustrating a front view of the packaging assembly pallet system of FIG. 3*a*.

Figure 1B:
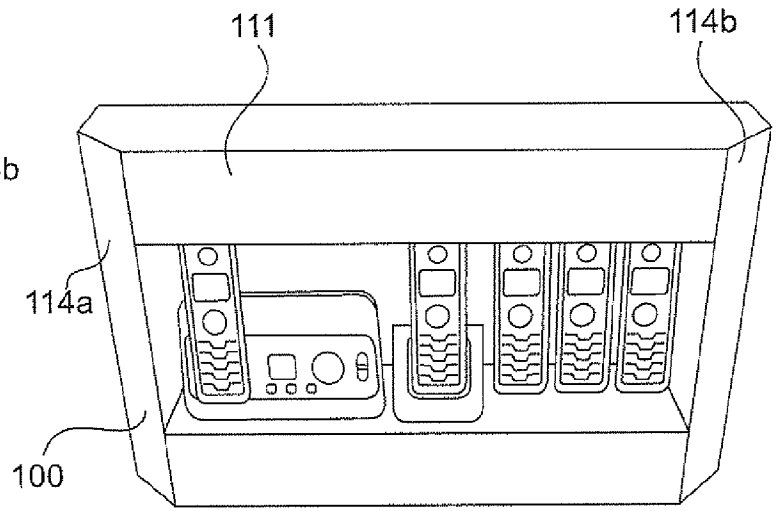
FIG. 1*b* is a schematic diagram of a top perspective view of a packaging assembly arranged in accordance with an embodiment of the present invention.

The invention will be described with reference to the accompanying drawings. Corresponding reference characters indicate corresponding parts throughout the several views. The description as set out herein illustrates an arrangement of an embodiment of the present invention and is not to be construed as limiting the scope of the disclosure in any manner.

DETAILED DESCRIPTION OF THE INVENTION

FIGS. 1*a*-7*c* show aspects of a packaging assembly and packaging system according to embodiments of the present invention.

Figure 1A:
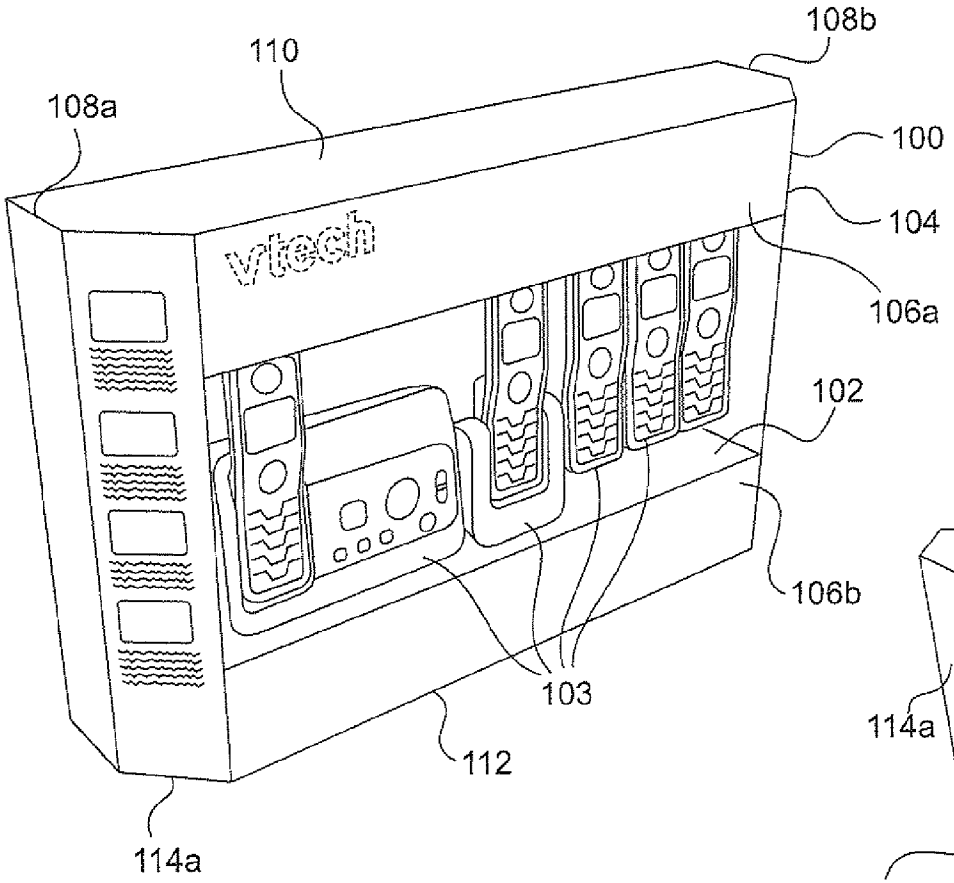
FIG. 1*a* is a schematic diagram illustrating a perspective view of a packaging assembly arranged in accordance with an embodiment of the present invention.
Figure 1C:
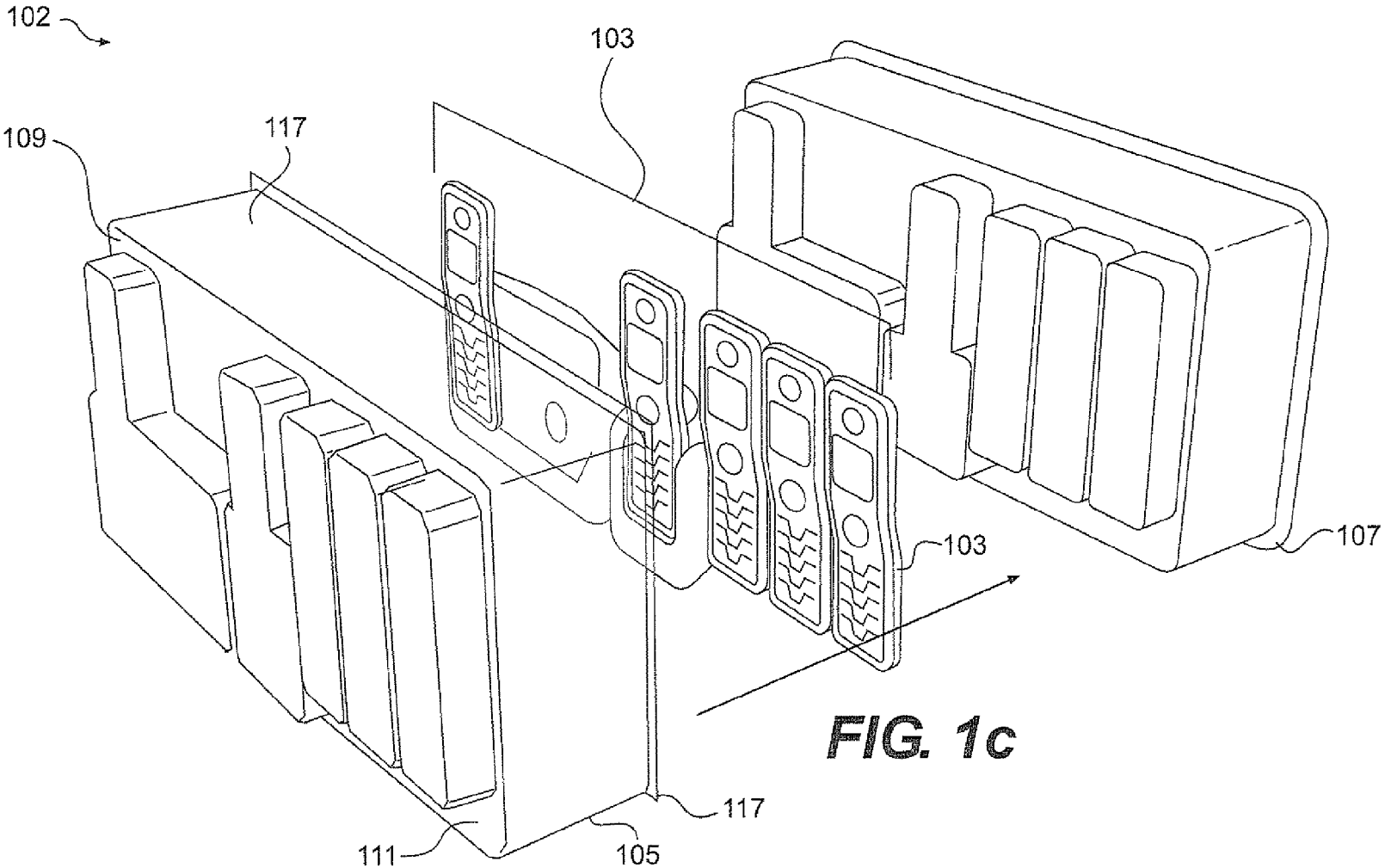
FIG. 1*c* is a schematic diagram of an exploded perspective view of an inner portion of a packaging assembly, in accordance with an embodiment of the present invention.

FIGS. 1*a* and 1*b* are a perspective view and top perspective view, respectively, of a packaging assembly (also termed "package assembly" or "assembly") 100 arranged in accordance with an embodiment of the present invention. Assembly 100 includes an inner portion 102 that is designed to contain a product, such as telephones 103. In accordance with an embodiment of the present invention as depicted in the exploded view of FIG. 1*c*, inner portion 102 can include base portion 107 and cover portion 105 that, when brought together, encapsulate product 103.

In an embodiment of the present invention, cover portion 105 is a substantially transparent hard plastic material that provides a clear view of a product contained therein. In one embodiment of the present invention, base portion 107 is a sheet-like recyclable pulp material that can be molded into a desired three-dimensional shape to accommodate a product. However, base portion 107 can be any moldable material, may be transparent, translucent, or opaque, and may be disposed as a thin layer of material. In other words, base 107 can be formed from a thin material having a hollow cavity back that can be manufactured by known methods, such as forming on a mold having a shape tailored according to the product(s) to be held on the base.

In accordance with embodiments of the present invention, the cover 105 and base 107 portions may be joined together in a semi-permanent fashion, along any one or several of their respective sides, such that removal of product from cover 105 is difficult when inner portion 102 is in place. In one example, cover 105 includes flaps 117 that wrap around the edges of base 107 and fold back underneath base 107 into the hollow back cavity of base 107. In another example, cover 105 could be attached to base 107 by adhesive in one or more locations along the edges of the components.

Referring again to FIG. 1*a*, and also to FIG. 4, assembly 100 includes an outer portion, also termed a "housing" 104 that is designed to house inner portion 102. Housing 104 includes top front and bottom front panels 106*a* and 106*b*, respectively, which preferably lie in a common planar surface that defines the front side of assembly 100. Housing 100 also includes rear panel 120, as well as side panels 108*a* and 108*b* that are preferably orthogonal to the front side. Housing 104 additionally includes bottom panel 112 (shown only as a front edge) and top panel 110 that are each preferably orthogonal to the front and side panels.

Housing 104 thus is configured as a window box design, in which the display window containing inner portion 102 is surrounded by panels 106*a*, 106*b*, 108*a* and 108*b*.

In the embodiment of the present invention depicted in FIG. 1*a*, assembly 100 includes chamfered portions (or "chamfer panels") 114*a* and 114*b* that lie along opposite vertical sides of the front side of assembly 100. Chamfer panels 114*a*, 114*b* each intersect a respective side panel along a common edge, preferably at an angle of about thirty to sixty degrees. Portions of each chamfer panel also intersect portions of top and bottom front panels 106*a*, 106*b*.

In one embodiment of the present invention, housing 104 is configured to open up along at least one side, such that the inner portion 102 containing product 103 can be slidably removed or inserted into housing 104.

In one configuration of the present invention, housing 104 includes a retaining portion configured to retain inner portion 102 when the inner portion 102 is inserted within housing 104. In one embodiment of the present invention, the top and bottom front panels 106*a* and 106*b*, respectively, are configured to engage portions 109 that lie along the perimeter of an outer surface 111 of the inner portion to hold the inner portion in place and prevent inadvertent removal, such that the inner portion cannot inadvertently or deliberately be easily removed from the packaging assembly through the open region defined by the panels 106*a*, 106*b*, 114*a*, and 114*b*.

Figure 2B:
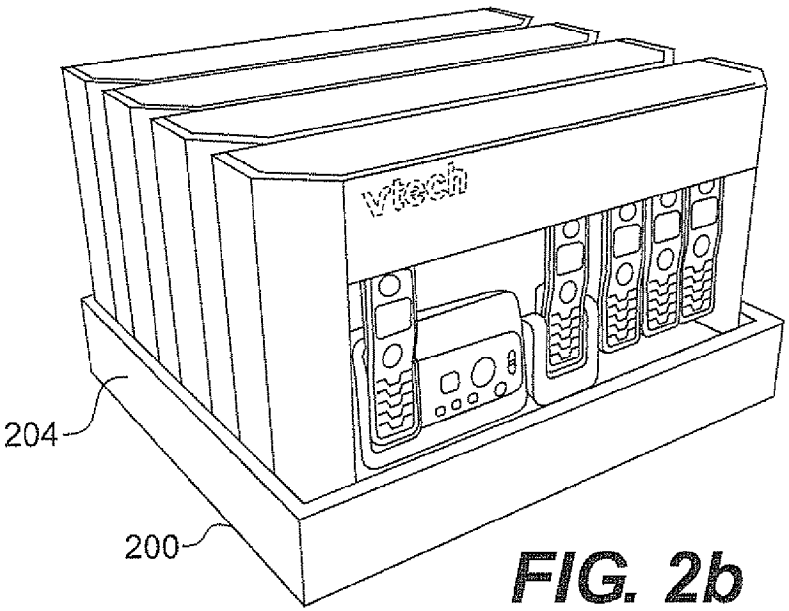
FIG. 2*b* is a schematic diagram of a perspective view of a packaging assembly tray system of FIG. 2*a*.
Figure 2A:
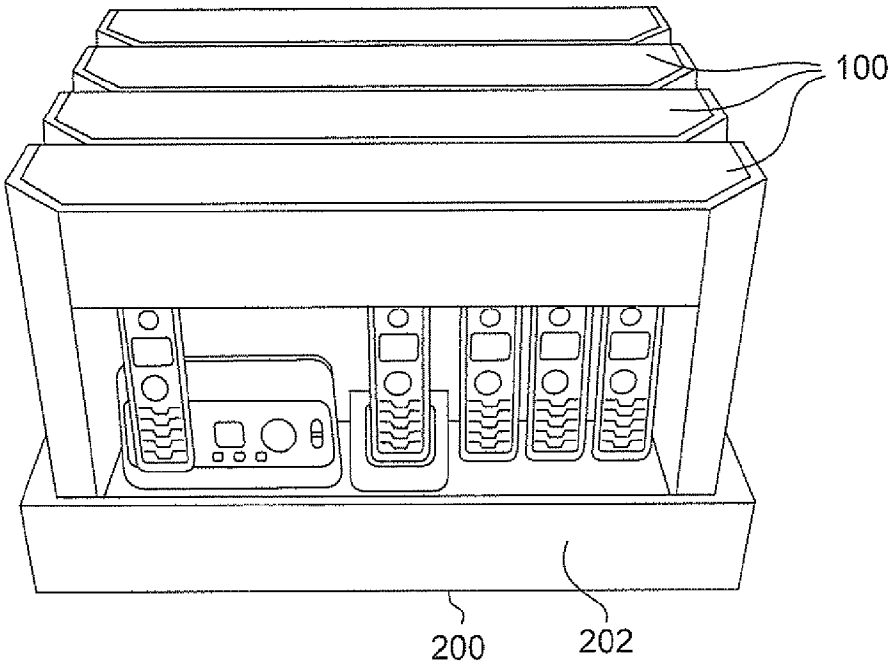
FIG. 2*a* is a schematic diagram of a top front perspective view of a packaging assembly tray system arranged in accordance with an embodiment of the present invention.

FIGS. 2*a* and 2*b* are a top front perspective view and a perspective view, respectively, of a packaging assembly tray system 200, arranged in accordance with an embodiment of the present invention. Tray system 200 includes a plurality of packaging assemblies 100 that are packed into a dense one dimensional array containing four assemblies. The front surface of one assembly can abut the back surface of a second assembly immediately in front, so that a maximum packing density can be achieved in a tray 200. The height of retaining wall 204 of tray 200 can be sufficient to prevent assemblies 100 from readily falling out of a tray.

The housing 102 of an individual assembly can comprise a material that has a relatively high strength to weight ratio so that each assembly can be arranged to remain upright and stable when resting on a relatively narrow horizontal bottom portion, either as a free-standing assembly, or in a close-packed array in a tray, such as tray 200. Thus, bottom panel 112 has a surface area large enough so that the packaging assembly 100 stands on its own while being transported or displayed and supports weight placed on the top of the assembly.

Figure 3B:
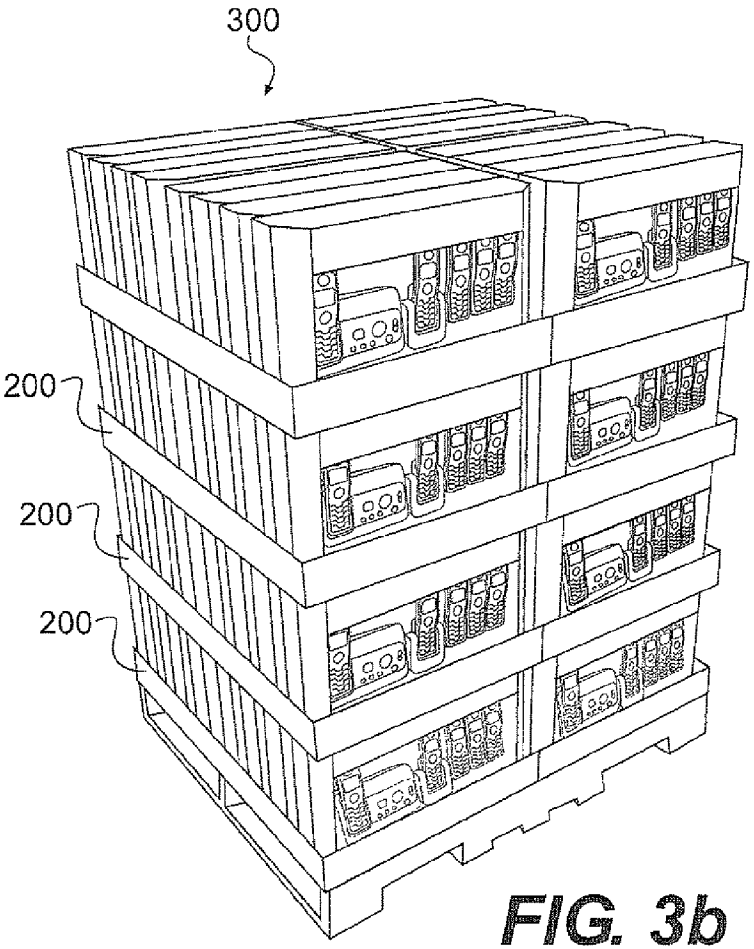
FIG. 3*b* is a schematic diagram of a top and side perspective view of the packaging assembly pallet system of FIG. 3*a*.
Figure 3A:
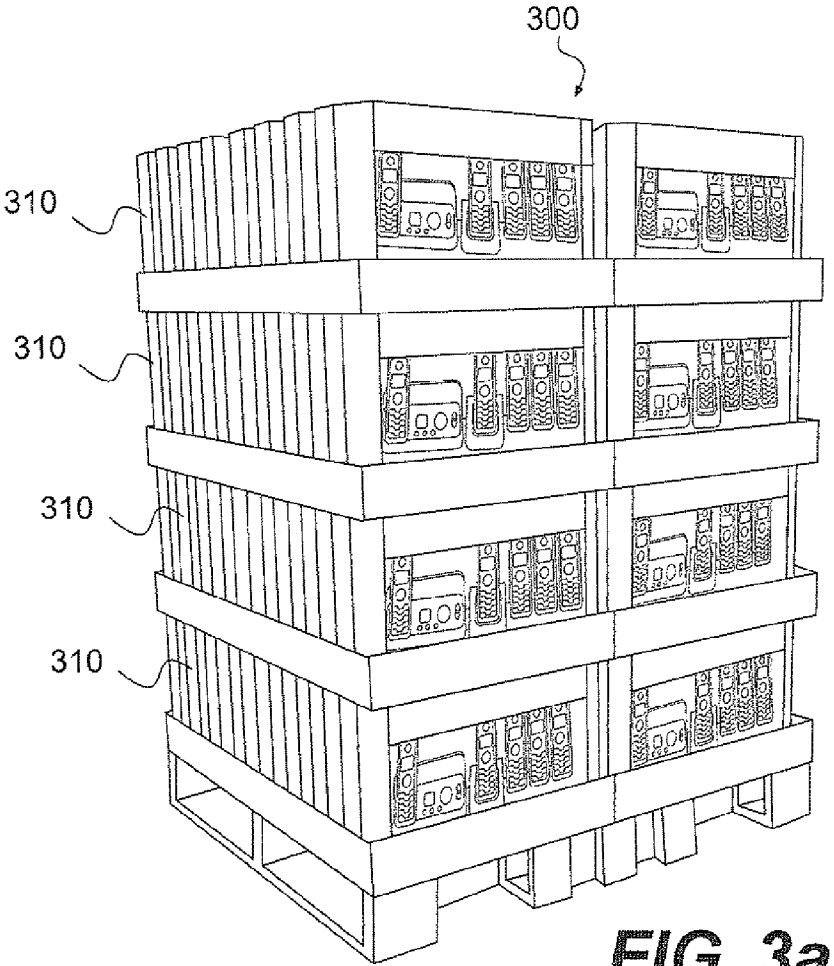
FIG. 3*a* is a schematic diagram of a side perspective view of a packaging assembly pallet system arranged in accordance with an embodiment of the present invention.

FIGS. 3*a* and 3*b* are perspective views of a packaging assembly pallet system 300 arranged in accordance with an embodiment of the present invention. Pallet system 300 is configured to display a plurality of packaging assemblies 100 that are arranged within a group of trays 200. Trays 200 of pallet system 300 are arranged in a series of layers, where each layer 310 includes a plurality of trays 200.

Referring now to a schematic depiction of system 300 shown in FIGS. 5*a*-5*c*, the pallet system 300 includes four layers 310. Each layer contains a set of four trays 200 arranged in a densely packed two-by-two array where adjacent trays are very close to or abut each other.

Referring again to FIGS. 3*a* and 3*b*, it is notable that pallet system 300 is configured to provide useful product information to a user from any perspective. A user standing in front of the pallet sees actual product contained within each packaging assembly 100, for those assemblies located in the front of the pallet. In addition, front top panel 106*a* (see FIG. 1*a*) contains specific product information, such as manufacturer and type of product, as well as specific salient product features. In an embodiment of the present invention, top and bottom panels 106*a* and 106*b* include substantially the same information, such that when assemblies 100 are stored in trays 200, all of the information on lower front panels 106*b* that is masked to the viewer by tray sidewalls 204 is still available to the viewer on top front panels 106*b*. This is useful when packages are stored in trays, such that the front retaining wall of a tray obscures the bottom front panel 106*b* from view.

It is also notable that chamfers 114*a*, 114*b* (see FIGS. 1*a*, 1*b*) provide product-specific information, such as pictures and text, to a viewer located in front or on either side of the pallet system 300. In addition, in an embodiment of the present invention, rear panels 120 also include substantial product information, such as pictures. Thus, a shopper is readily provided useful visual information about the product from all sides of pallet system 300, even though the packaging assemblies 100 are arranged in dense arrays.

In particular, the chamfers 114*a*, 114*b* can greatly increase the visual impact of the product packaging in a pallet configuration. Often, the pallet configurations are placed on the ground, under shelves, and next to other pallet stacks, such that the sides of the pallet configurations are not easily viewed. The chamfers 114*a*, 114*b* provide a beneficial angled surface that a consumer can view as she walks along the aisle, approaching the pallet from either direction. In this manner, the consumer can view and read the packaging not only from directly in front of the pallet, but also from the sides as she approaches the pallet.

In other words, the packaging information provided on each chamfer portion can be viewed from the front of the pallet, from a position that is partially in front and partially to the side of the pallet, and from a position that is directly to the side of the pallet, corresponding to positions A, B, and C, respectively, illustrated in FIG. 5*a*. The term "directly to the side" as used with respect to a pallet or package assembly denotes a position near a pallet that provides a viewer facing the pallet no line-of-site view with the window region of a packaging assembly. Thus, a shopper walking along side of pallet 300 is directly to the side of the pallet approximately between points D and E that represent two corners of the pallet.

Advantageously, the use of a chamfer provides a relatively larger surface on the lateral portions of a package assembly with which to provide information to a shopper, as opposed having only a side of the package that is angled at about ninety degrees with respect to the front of the package. For example, in a packaging assembly in which a side panel 108*a* or 108*b* has about half the depth of the package, and a chamfer 114 is disposed at an angle of about forty five degrees, the side panel and chamfer portions together provide about 21% greater surface area than a ninety degree angled side panel having the full depth of the packaging assembly.

As noted above, the double chamfer structure in which chamfers are disposed on both sides of a packaging assembly, provides a viewable chamfer portion to a user standing next to a pallet, even when the pallets contain two-wide arrays of packaging assemblies in which packaging assemblies are arranged side-by-side, such that each chamfer facing toward the middle of the pallet is obscured, as depicted in FIG. 3*b*.

As depicted generally in FIGS. 1*a*-5*c*, the packaging assembly 100 is configured such that an inner portion housed within housing 104 lies "entirely within" the three dimensional window defined by housing 104. In other words, an insert 102 lies behind a front surface of the window defined by top and bottom front surfaces 106*a* and 106*b*, respectively. This facilitates the dense packing of packaging assemblies 100 depicted in FIGS. 5*a*-5*c*, in which the front of a packaging assembly 100 contacts the back of an adjacent packaging assembly.

FIGS. 6*a*-6*m* depict exemplary features of a packaging assembly 600, at various stages of assembly, in accordance with embodiments of the present invention. The succession of assembly stages depicted in FIGS. 6*a*-6*m* represents exemplary steps involved in a method for assembling packaging assembly 600, in accordance with one embodiment of the present invention.

Figure 6A:
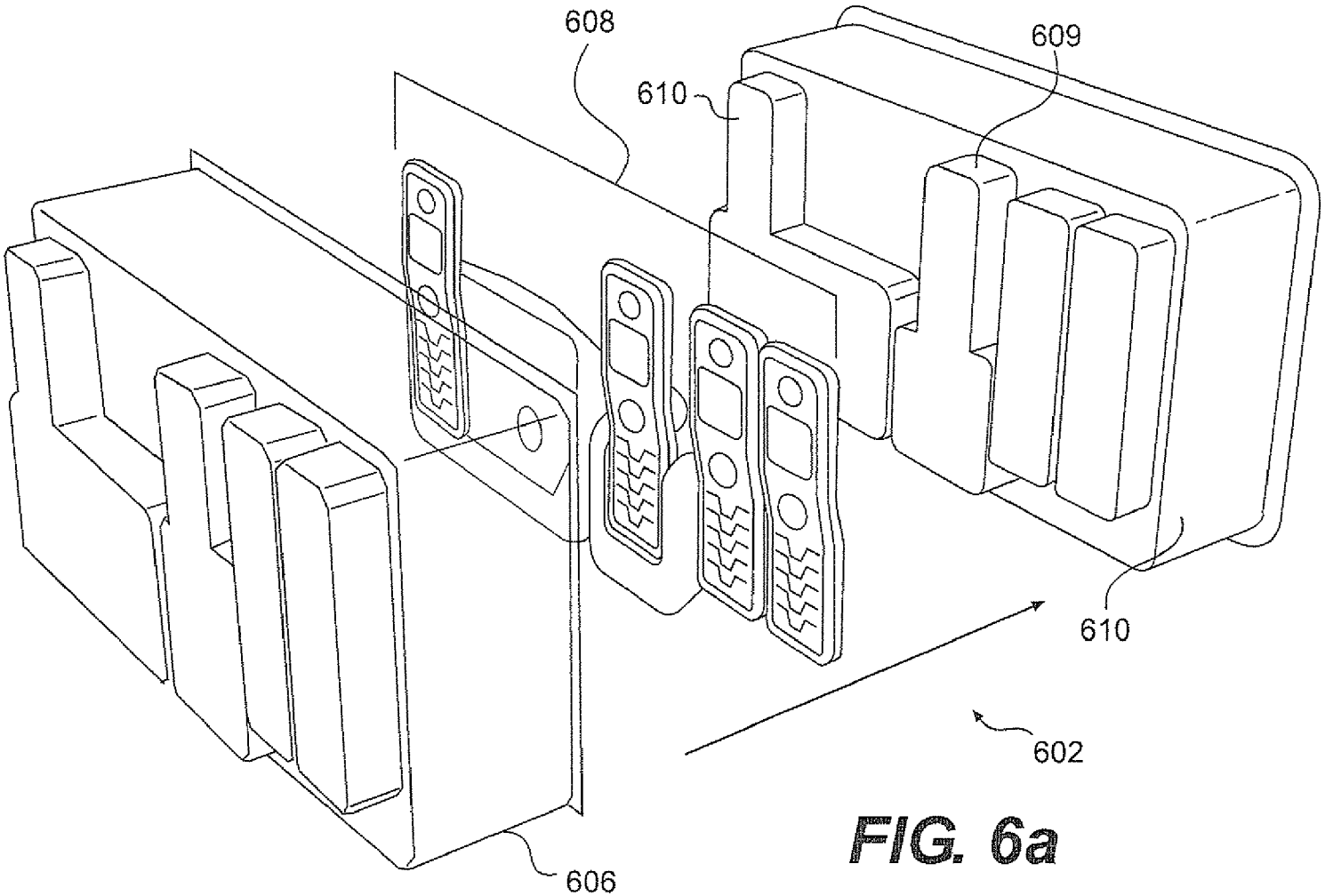
FIGS. 6*a*-6*m* depict exemplary features of a packaging assembly at various stages of assembly, according to an embodiment of the present invention.
Figure 6C:
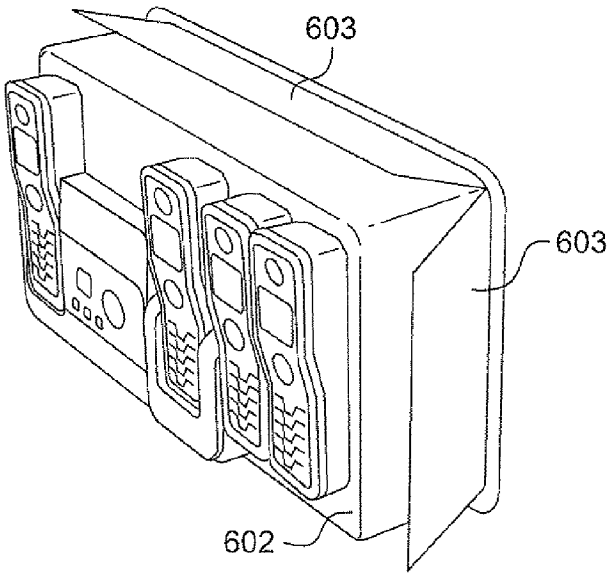
Figure 6B:
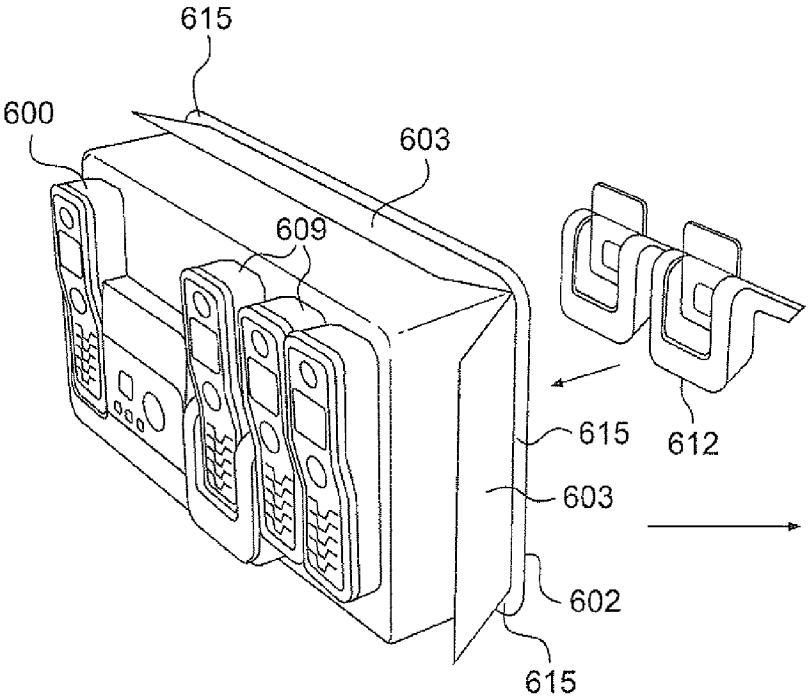
Figure 6E:
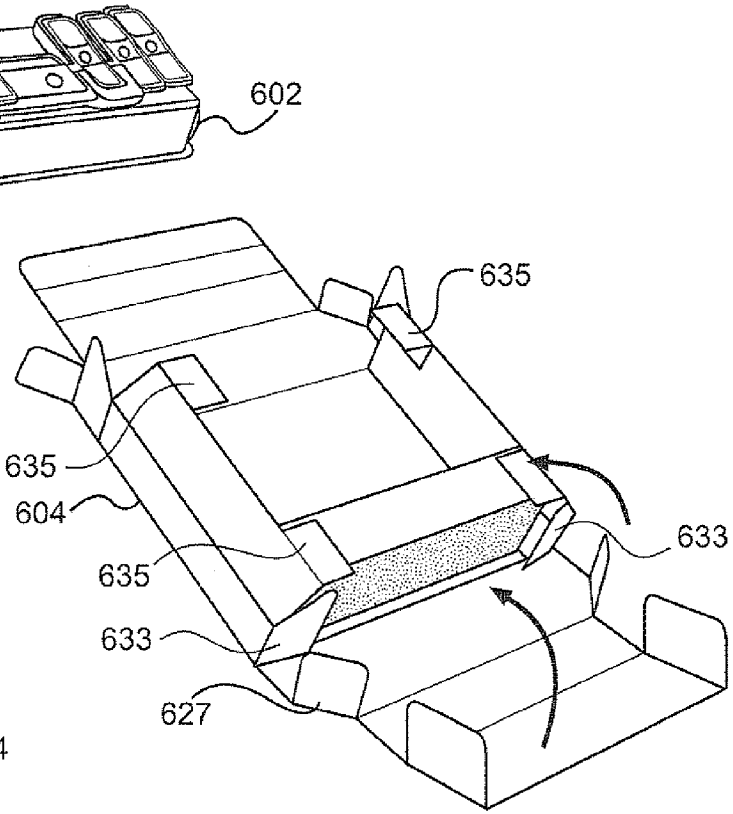
Figure 6D:
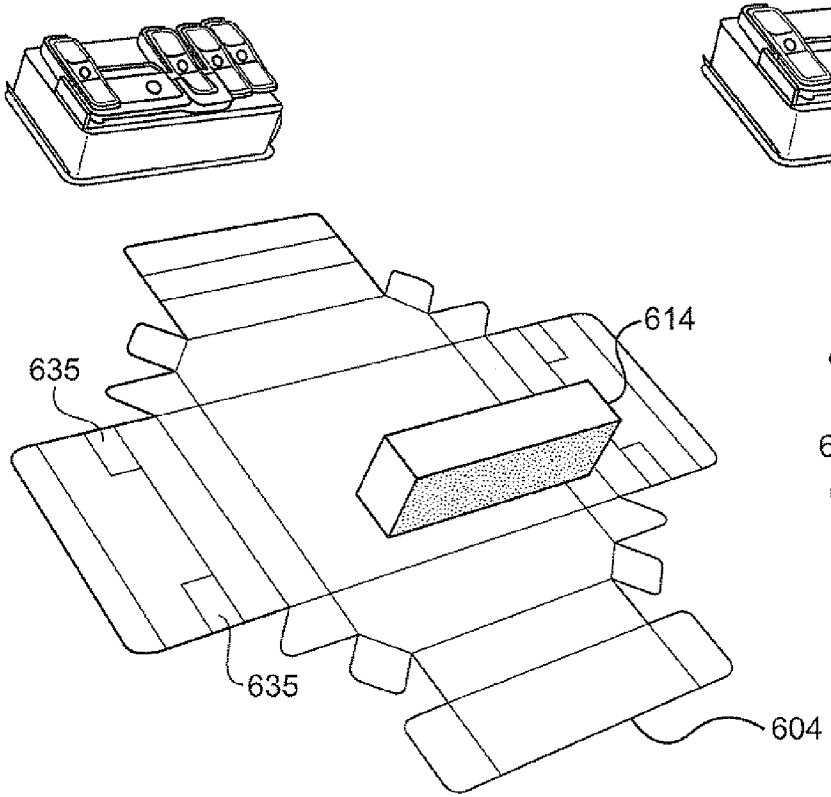
Figure 6G:
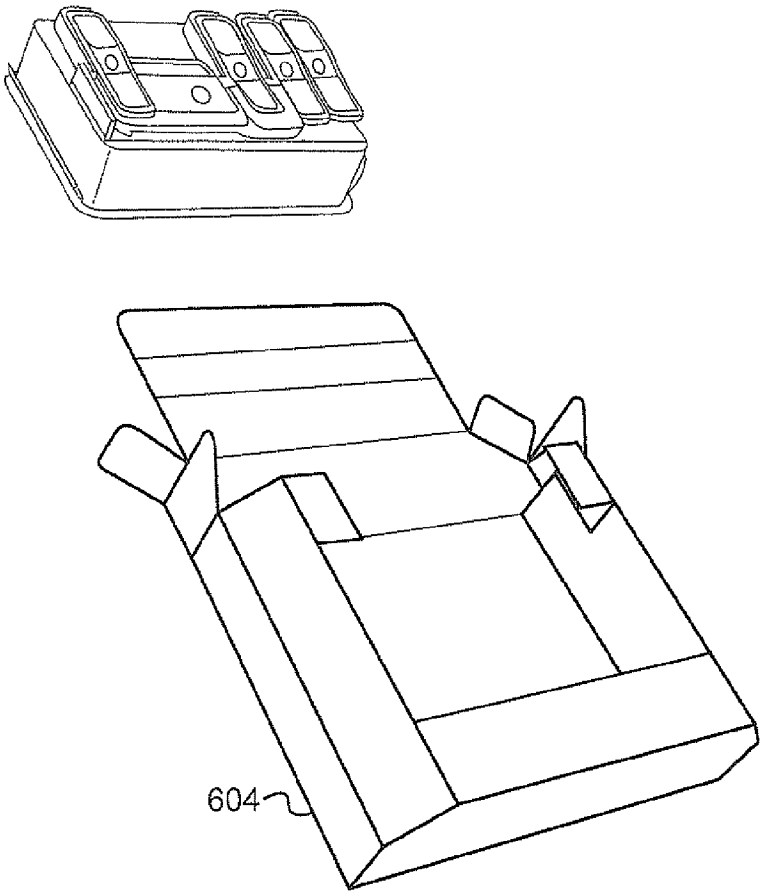
Figure 6F:
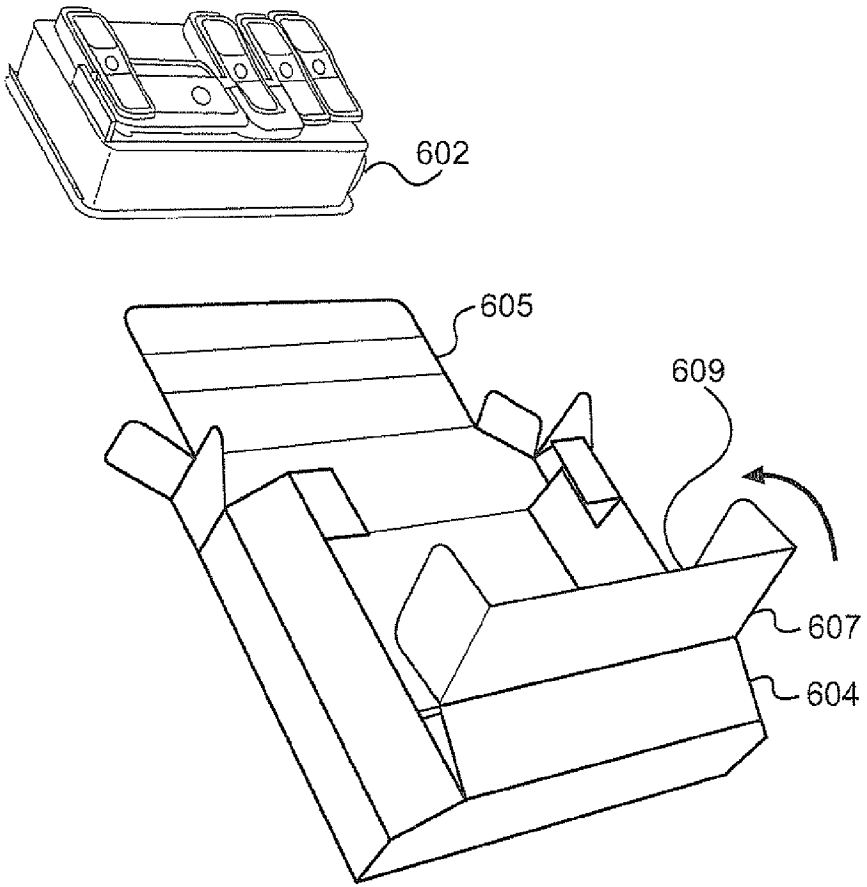
Figure 6I:
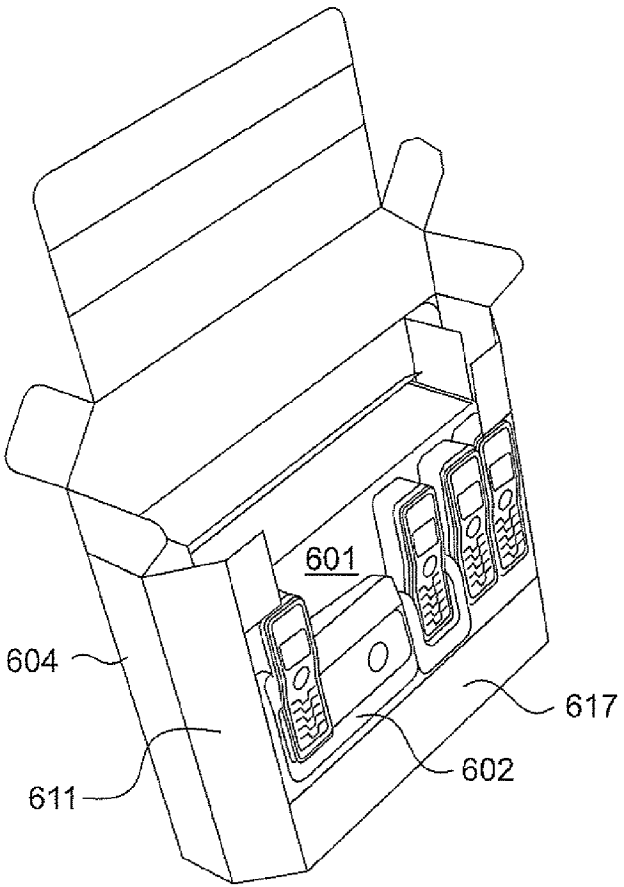
Figure 6H:
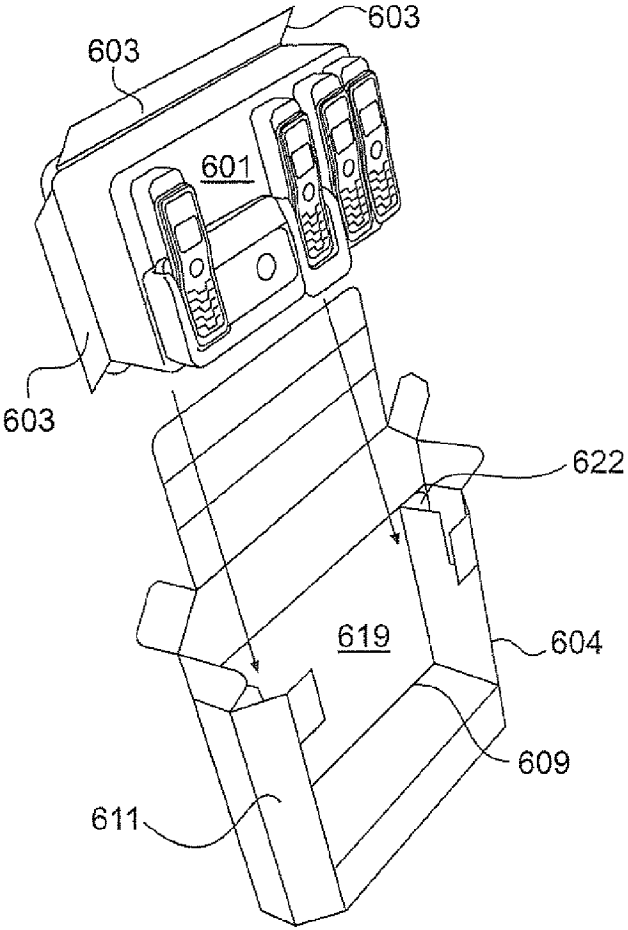
Figures 6J, 6K:
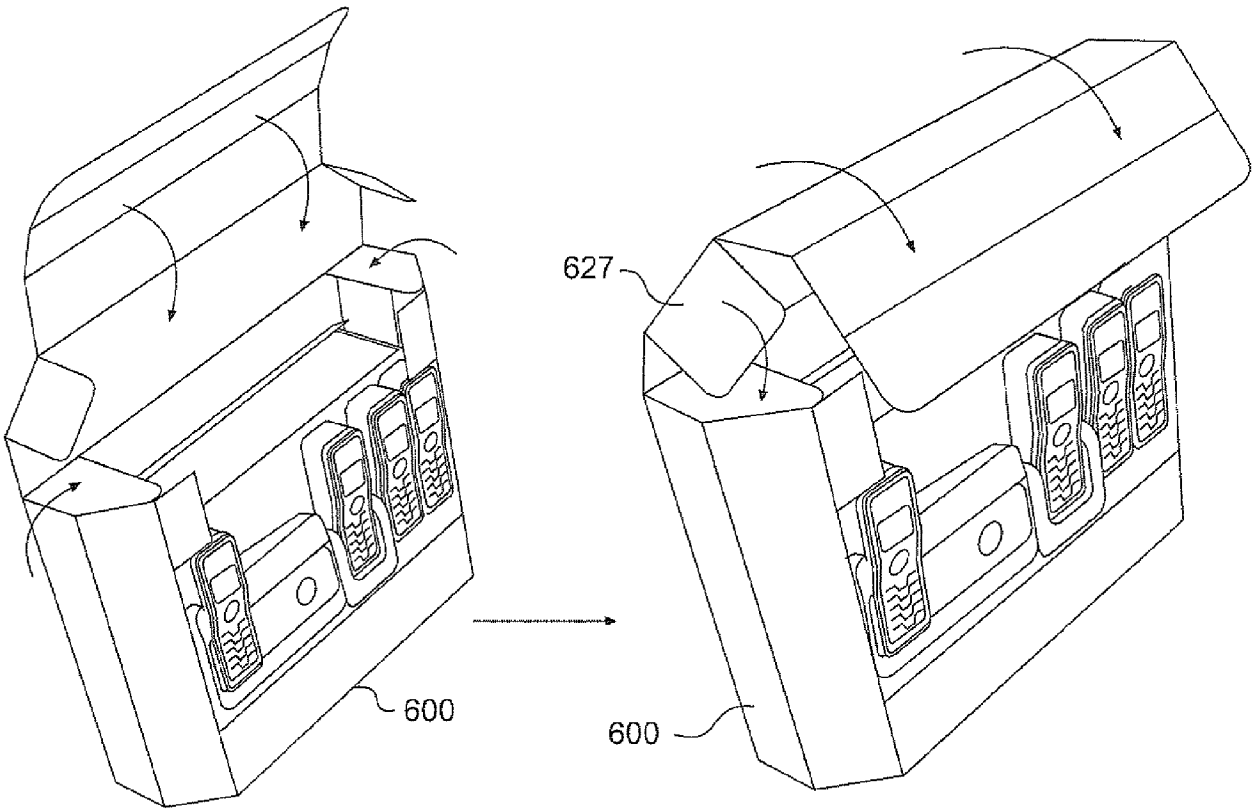
Figure 6M:
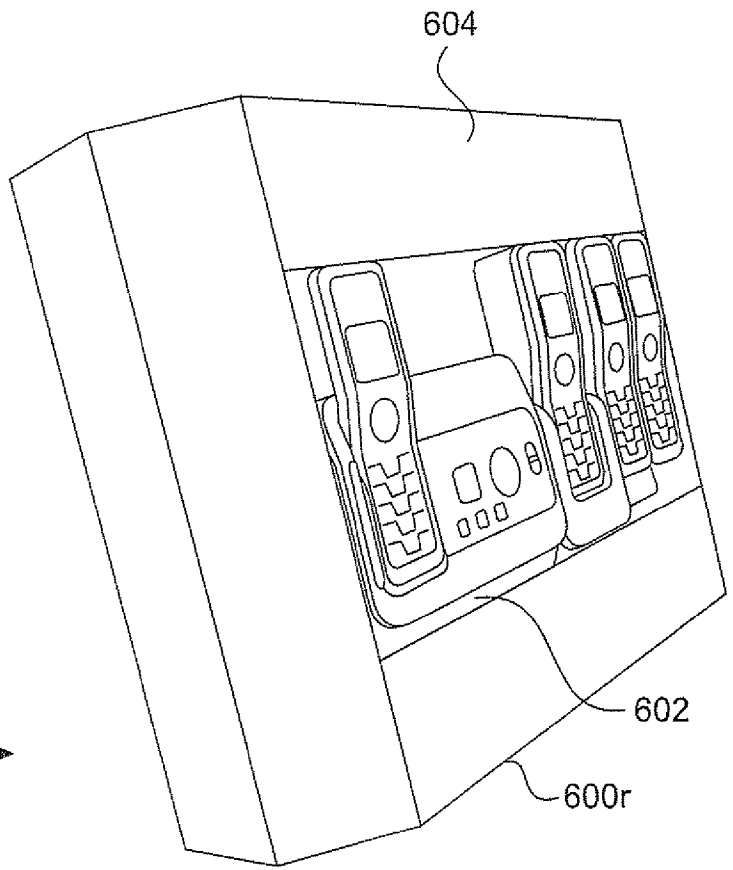

As depicted in FIG. 6*m*, packaging assembly 600 includes housing 604 and inner portion 602 that contains a product to be displayed.

FIG. 6*a* depicts an exploded view of an inner portion 602. A product 608, in this case, a set of cordless telephones, is housed between the transparent front portion 606 and a backing 610. Front portion 606 is molded in a manner to match the size and shape of components of cordless telephone set 608. Similarly, backing 610 is molded such that raised portions match the size and shape of the components 608. Backing 610 can be an opaque material, such as molded pulp, that is substantially hollow.

FIG. 6*b* depicts a perspective view of an assembled inner portion (insert) 602. As assembled, components of cordless telephone set 608 are prominently positioned on raised portions 609. In the embodiment depicted in FIG. 6*b*, insert 602 is configured to house chargers 612 inside of a hollow backing 610, such that a customer viewing packaging assembly 600 cannot see the chargers (see FIG. 6*c*).

As further depicted in FIG. 6*c*, insert 602 contains flange portions 603. When packaging assembly 600 is fully assembled, flange portions 603 are configured to engage housing 604, such that insert 602 is retained within packaging assembly 600, as discussed further below. Similar extension portions and other configurations are described in the commonly-assigned U.S. application Ser. No. 11/389,247, filed Mar. 27, 2006, which is herein incorporated by reference in its entirety.

FIGS. 6*d* and 6*e* depict initial stages of assembly of housing 604, in accordance with an embodiment of the present invention. Housing 604 is initially configured as a flat shape, as depicted in FIG. 6*d*. Housing 604 comprises flaps and foldable portions that are configured to assemble into a three dimensional shape that holds insert 602, as depicted in FIGS. 6*e*-6*m*. The term "three dimensional" as used herein in the context of a housing or components of housing, such as side, front, and top portions of a housing "window box," refers to the fact that the housing or housing components have substantial size in three mutually orthogonal directions. For example, the housing window box structure as depicted in FIG. 6*m* has sufficient depth to accommodate a product insert within the window box, without that product insert protruding out of the window box. Thus, in addition to having a length and width sufficient to display the product in the insert, the depth of the window box of FIG. 6*m* can range up to many inches. Additionally, the window box "sides" each have a substantial depth, width, and height.

In the embodiment of the invention shown in FIGS. 6*d* and 6*e*, housing 604 is configured to house an accessory pack 614 that can be used to hold chargers, batteries, cables, and/or other accessory components of the product 608.

In the embodiment of the present invention depicted in FIGS. 6*d* and 6*e*, housing 604 is configured to retain accessory pack 614 behind a bottom front portion that folds up to surround accessory pack 614 after the accessory pack is placed in the appropriate location of the flat housing 604.

As depicted in FIGS. 6*f*-6*i*, housing 604 is configured to fold in such a manner that insert 602 can be inserted into a partially assembled housing 604 through a top region that remains open until insert 602 is fully within housing 604.

As depicted in FIG. 6*f*, housing 604 includes a top flap portion 605 and a bottom flap portion 607. Top flap portion 605 is configured to fold into a structure whose front portion constitutes a top front panel, similar to panel 106*a* depicted in FIG. 1*a*. Bottom flap portion 607 is configured to fold inwardly to form a horizontal surface orthogonal to the front of assembly 600.

In one embodiment of the present invention, as illustrated in FIGS. 6*f* and 6*i*, the distal edge 609 of bottom flap portion 607 is configured to abut against a lower portion of flange 603, when inner portion 602 is inserted in housing 604 and bottom flap portion 607 is folded inwardly. In configurations of the present invention, a region of top flap portion 605 can also be configured to abut against flange 603 when top flap portion 605 is folded in place.

Subsequently, as depicted in FIGS. 6*j*-6*m*, top portions of housing 604 are folded downwardly and inwardly to restrain insert 602 from the top.

Figure 6L:
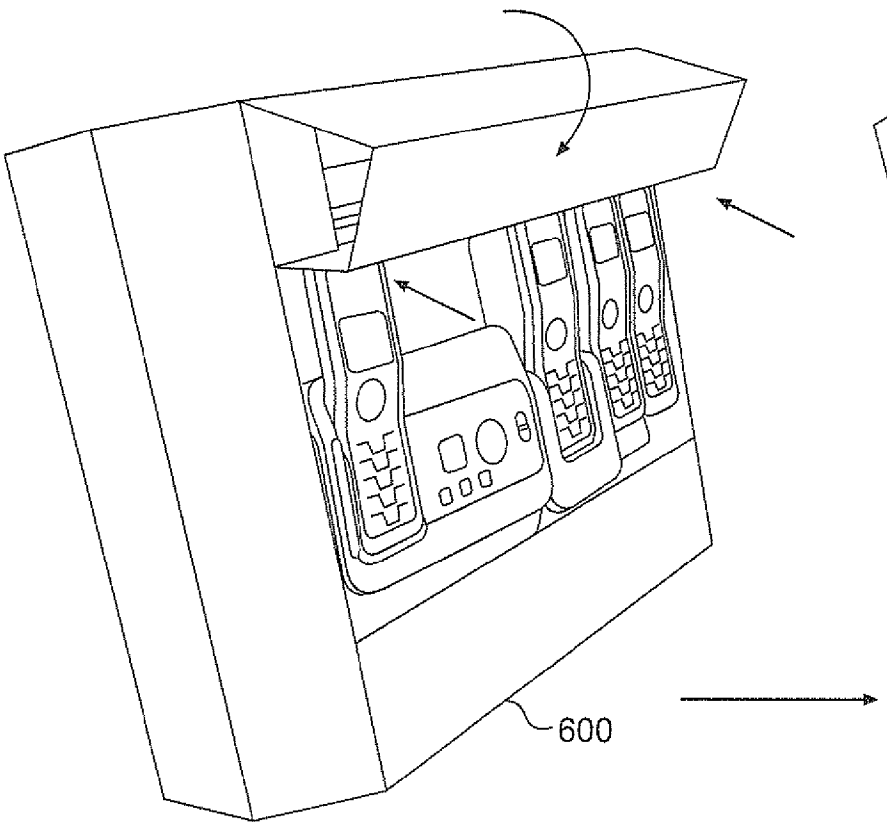
Figure 7B:
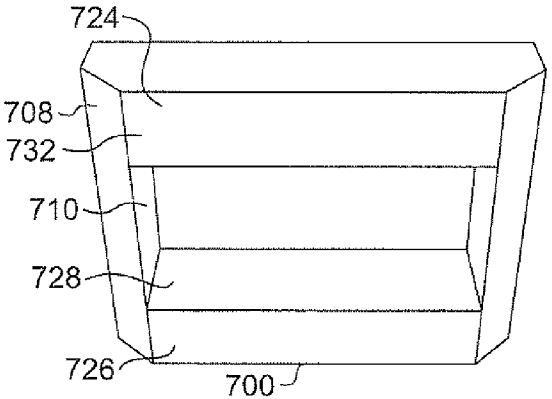
FIGS. 7*b* and 7*c* depict a top front view and perspective view of the assembled housing of FIG. 7*a*.
Figure 7C:
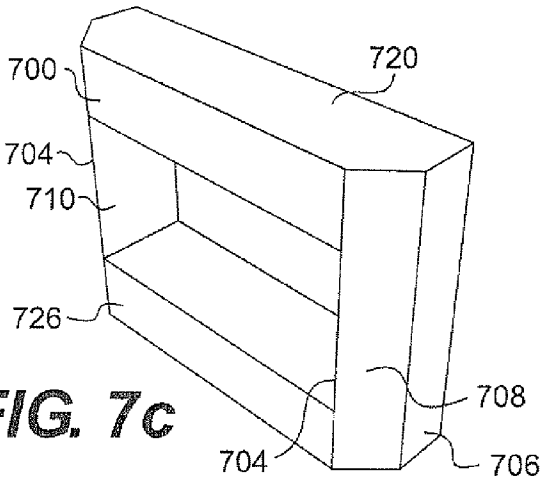
Figure 7A:
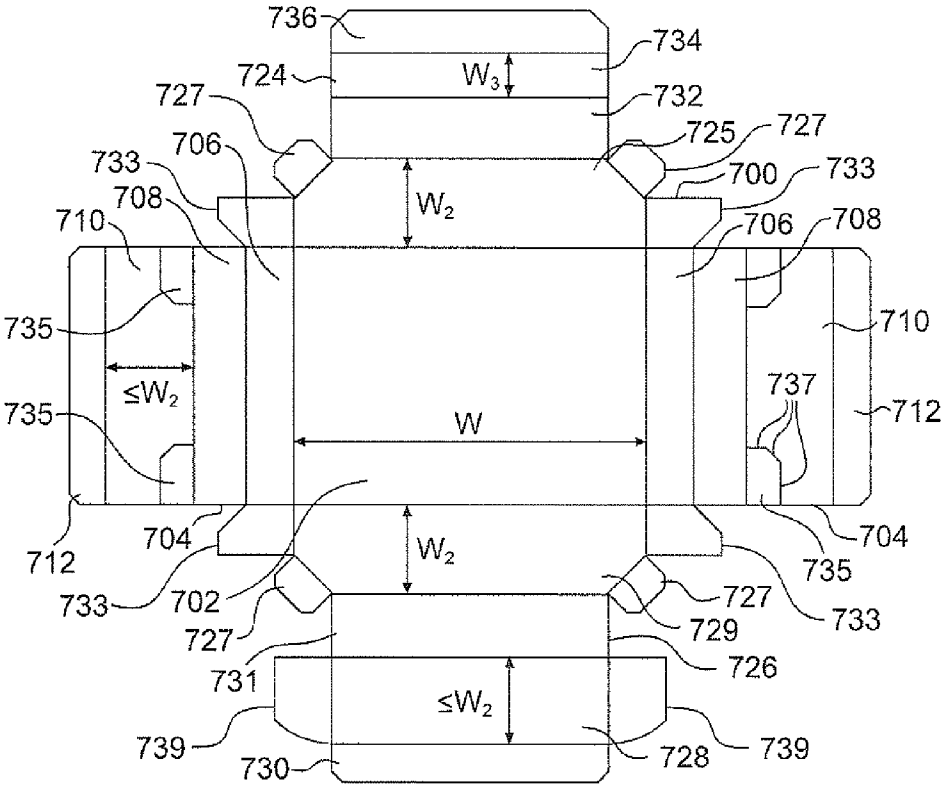
FIG. 7*a* depicts an initial configuration of a packaging assembly housing according to an embodiment of the present invention.

In accordance with another embodiment of the present invention, FIG. 7*a* depicts a packaging assembly housing 700 in an initial configuration before folding and assembly of the housing into a final configuration designed to house an insert (not shown), as illustrated in FIGS. 7*b*-7*c*, Except where otherwise indicated, housing 700 is substantially similar to housing 600 depicted in FIGS. 6*d*-6*m* and described above. In accordance with embodiments of the present invention, the width of housing 700 as viewed from the front is designed according to the size of the insert to be contained in housing 700. For example, housing 700 can be configured in different widths W that are each appropriate to hold a respective product insert that contains between 1 and 6 handsets of a cordless telephone system.

In the initial configuration, housing 700 is a thin, substantially flat and unitary object that can be arranged in stacks of housings 700 for convenient storage and transport before the housing is assembled into the configuration shown in FIGS. 7*b* and 7*c* (without the inner portion containing the product shown). Housing 700 can be a cardboard, a paper-based material, a composite material, a corrugated material, or other material that is provided with predetermined folds wherein the flat housing sheet can be conveniently folded and maintain sufficient rigidity in the folded state to retain the shape shown in FIGS. 7*b* and 7*c* and to support the weight of a product contained therein. It will be appreciated that the strength of the material used for housing 700 can vary according to the size and weight of the product to be contained therein; however, the rigidity of housing 700 is generally sufficient such that packaging assemblies using housing 700 can be arranged in stacks, as depicted, for example, in FIGS. 3*a* and 3*b*.

The configuration of housing 700 depicted in FIGS. 7*a* and 7*b* comprises a three-dimensional window box in which the window region lies between "window frame" members that comprise three dimensional upper 724, lower 726, and side portions 704, which each have an inner surface facing toward an insert placed in the window (not shown), and one or more outer surfaces, as described further below. The housing 700 provides a robust frame to protect a product disposed in the window area, while at the same time providing a clear display of the product and product information. In accordance with embodiments of the present invention, each of the window frame members is configured to be substantially hollow, thereby providing a lightweight but strong window frame, which can accommodate additional inserts within the window frame, for example product components that are not needed or desired to be displayed in the window box.

In the flat configuration illustrated in FIG. 7*a*, housing 700 comprises a cross-type shape having two side portions 704 arranged on opposite sides of a central portion 702, which constitutes the back of an assembled housing structure shown in FIGS. 7*b*-7*c*. In the embodiment of the present invention illustrated in FIG. 7*a*, top portion 724 differs slightly in structure with bottom portion 726, as discussed further below. Side, top, and bottom portions of housing 700 are configured to fold into the three dimensional structure of FIGS. 7*b* and 7*c*, in a manner similar to that depicted for housing 604 in FIGS. 6*d*-6*m*. For example, side portions 704 can initially be folded in a manner similar to that depicted in FIG. 6*e*, after which bottom portion 726 is folded up, followed by the folding of top portion 724.

Side portions 704 each include side panels 706, chamfers 708, inner walls 710, and back portions 712. As illustrated also in FIG. 7*c*, side panels 706 are configured to assume an angle of about ninety degrees with respect to back section 702, when housing 700 is fully assembled. Chamfers 708 are configured to form outwardly facing panels that form an angle with respect to side portions 706 that is preferably in the range of about thirty to sixty degrees. In one embodiment of the present invention, the width of inner walls 710 is about equal to the depth of the assembled housing 700, as defined by the width $W_2$ of top panel 725 and bottom panel 729. The inner walls 710 are configured to form an angle in the range of about ninety degrees with respect to back portion 702. Back flaps (back panels) 712, which are adjacent to inner walls 710, are configured to fold with their respective outer (unattached) edges extending toward sides 706 so that the back flaps are not visible when housing 700 is assembled into the configuration depicted in FIGS. 7*b*-7*c*. Corner flaps 733 of side portions 704 are configured to fold parallel to the top and bottom of the assembled housing 700 so that corner flaps 733 are orthogonal to side panels 706 and chamfers 708, as illustrated for similar corner flaps 633 in FIG. 6*e*.

Additionally, cutout flaps 735 can be provided to add stability to the housing 700 when fully assembled. Cutout flaps 735 are attached to housing 700 at the vertical edge shared with chamfer 708. However, cutout surface 737, which comprises a plurality of edges, is not attached to housing 700. Operation of cutout flaps 735 can be better understood with reference to FIG. 6*d* and 6*e*, which depict similar flaps 635. When the side portions are assembled as shown in FIG. 6*e*, the flaps 635 are configured to detach along the cutout surface from the rest of the inner facing panels (see panels 710 in FIGS. 7*a*-7*c*), such that flaps 635 face parallel to the front of the housing. Subsequently, the cutout flaps form support for the top panel portions when assembly is completed, as illustrated in FIG. 6*j*-6*l*.

Referring again to FIGS. 7*a*-7*c*, when assembled, side portions 704 provide stability to package 700, as well as providing a surface for displaying information to a shopper, as described above.

Lower portion 726 is configured to fold into the arrangement depicted in FIGS. 7*b* and 7*c*, wherein bottom panel 729 is substantially orthogonal to central portion 702. Bottom panel 729 has substantially the same shape and size as that of top panel 725. Flaps 727 are configured to fold inwardly inside the top and bottom portions of chamfers 708, as illustrated by the action of flaps 627 of a similar housing 604 depicted in FIGS. 6*e* and 6*k*, respectively.

When fully assembled the side, angled, and front edges of top and bottom panels 725 and 729, respectively, define the angles formed between side portions 706 and chamfers 708 on the one hand, and the angle formed between chamfers 708 and front panels 731, 732 on the other hand.

As illustrated, lower front panel 731 is configured to fold into an assembled position in which bottom panel 729 is substantially orthogonal to lower front panel 731.

Lower portion 726 also includes lower inner portion 728 that is disposed adjacent to lower front panel 731. Lower inner portion 728 is configured to fold inwardly extending from the front of housing 700 toward the back 702 of housing 700 and forming a surface that is substantially orthogonal to lower front surface 731. In embodiments of the present invention, the width of lower inner portion 728 is less than or about equal to the width $W_2$ of top and bottom portions, as illustrated. In embodiments of the present invention in which an accessory pack is included in the housing 700, as illustrated for accessory pack 614, lower inner portion 728 can be supported by an accessory pack when in the assembled position depicted in FIGS. 7*b*-7*c*. This helps form a robust support for any insert that is placed in housing 700 and rests within folded lower portion 726 or on top of lower inner portion 728. In addition, in embodiments of the present invention, a pair of side support flaps 739 is provided on opposite ends of lower inner portion, wherein each side support flap is configured to fold against an inner wall of a side portion in an assembled state.

In the embodiment of the present invention illustrated in FIG. 7*a*, lower portion 726 further includes a lower back flap 730 that is configured to fold downwardly against the inner bottom region of back portion 702.

The folded lower portion 726 together with folded side portions 704 are configured to retain an insert, such as insert 602, in the manner generally depicted in FIGS. 6*h*-6*i*. Referring again to FIGS. 6*h* and 6*i*, which depict housing 604 having a side portion similar to side portions 704, the placement of an insert 602 is shown relative to side and bottom portions. In accordance with embodiments of the present invention, a set of flanges 603 (see FIGS. 6*b*, 6*c*, and 6*h*) provided on insert 602 (also termed "insert flanges") includes two side flanges and can further include a top flange, a bottom flange, or both a top and bottom flange. In accordance with embodiments of the present invention, the insert flanges are each attached to the insert at the bottom region of the insert and extend outwardly and upwardly from the perimeter of the bottom region. The bottom region of the insert refers to that region closest to a support surface, if the product insert is arranged so that the product faces upwardly and the base rests on the support surface. Thus, as illustrated in FIG. 6*b*, the bottom region 615 extends around the perimeter of the insert 602 in a region farthest from the surface of the insert that displays the product. Notably, the flanges may be provided on the cover portion 606 of the insert, which can be configured to surround the base portion 610 of the insert, wherein the cover portion extends to the bottom of the base portion when the insert is fully assembled, as suggested in the exploded view of FIG. 6*a*. Accordingly, flanges 603 can be flaps provided on a plurality of edges of the perimeter of the bottom region of cover portion 606.

As depicted in FIG. 6*h*, flanges 603 are configured to fold downwardly, such that the side flanges can fold into a flat position to extend outwardly from the insert bottom region to fit under back flaps on the side portions of the housing when the housing is partially assembled to the stage at which three dimensional side portions have been assembled, such as under back panels 622, or back panels 712 (not visible in the assembled configuration shown in FIG. 7*c*, but visible in the unassembled configuration shown in FIG. 7*a*). The side flaps are configured, such that, when folded into a flat position, the total width of the body of insert 602 and side flanges 603 is not greater than the width W of the assembled frame, such as frame 700 or frame 604. In the partially assembled configuration depicted in FIG. 6*h*, the window frame housing 604 comprises three dimensional side panels 611 and a three dimensional bottom panel 617 that define an intermediate window region 619 therebetween, which is configured to be large enough to accommodate product insert 602.

Thereby, insert 602 can be conveniently slid into the partially assembled frame from a top side by folding flanges 603 into a position that is substantially parallel to central portion 702 and moving insert 602 into the frame, as depicted in FIG. 6*i*. Flanges 603 are disposed underneath back panels 622 in the assembled configuration, while the top portion 601 of product insert 602 is housed within the intermediate window region 619.

In embodiments of the present invention in which a flange 603 is provided on the downwardly facing edge of an insert, such a "lower" flange can be inserted behind the lower portion of a partially assembled housing, such as under a lower back flap 730 (not visible in the assembled configuration shown in FIG. 7*c*, but visible in the unassembled configuration shown in FIG. 7*a*). However, for ease of placement of an insert into a housing, such as housing 700 or housing 604, a lower flange can be omitted from an insert that is to be placed into the housing from the top.

In addition, in other embodiments of the present invention, a housing lower portion need not include a lower back flap. For example, housing 604 as depicted in FIG. 6*f* does not include a lower back flap.

Referring again to FIG. 7*a*, upper portion 724, in addition to including top panel 725, also includes adjacent upper front panel 732, which is configured to be substantially orthogonal to top panel 725 in the assembled configuration depicted in FIGS. 7*b* and 7*c*. Upper inner portion 734 is disposed between upper front panel 732 and upper back flap 736.

When fully assembled, upper inner portion 734 extends backward from upper front surface 732 towards back portion 702, and upper back flap 736 extends upwardly behind upper front surface 732. In embodiments of the present invention in which an insert is provided with a flange along the top edge, the "top" flange is engaged by upper back flap 736, which further restrains the insert from moving. In embodiments of the present invention, the width $W_3$ of upper inner portion 734 is substantially the same as the depth of the housing $W_2$ Accordingly, when the top portion 720 is fully assembled, inner portion 734 extends such that back flap 736 contacts back wall 702. However, in other embodiments of the present invention, the width $W_3$ of upper inner portion 734 can be less than the depth of the housing $W_2$, as illustrated in FIG. 7*a*. This can facilitate easier folding of the top portion 720 when an insert is already in place in housing 700.

In summary, a packaging assembly for product display provides a robust window box-style housing that includes a window frame comprising three-dimensional top, side, and bottom portions that are lightweight but strong. The window frame surrounds an insert (inner portion) containing a product displayed in the "window" of the packaging assembly. The inner portion is configured with a plurality of flanges configured to couple with the side portions of the window box-style housing, and, in embodiments of the present invention, with top and/or bottom portions of the window box housing. Chamfers are provided along the side portions of the housing that provide enhanced viewability of information displayed to a shopper viewing the packaging assembly. The packaging assembly is configured for easy assembly of the housing and placement of insert within the housing, as well as storage and display in pallets containing arrays of packaging assemblies such that the shopper is provided with a clear display of the product and product information when viewing a pallet from a wide range of positions.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

For example, although the figures depict packaging for telephones, it would be readily apparent to one of ordinary skill that the packaging and display system of the present invention can apply to packaging for a multitude of products.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible.

What is claimed is:

1. A package assembly for displaying a product comprising:

an inner portion configured to contain a product and to provide a view of at least a portion of the product; and a housing portion, the inner portion disposed inside the housing portion and viewable through a front opening of the housing portion, the housing portion comprising:

a top panel, a bottom panel generally opposite to and parallel to the top panel, a first side panel generally orthogonal to the top panel and the bottom panel of the housing portion, a second side panel generally opposite to and parallel to the first side panel and generally orthogonal to the top panel and the bottom panel of the housing portion, a first chamfer panel disposed between the first side panel and the front opening, and a second chamfer panel disposed between the second side panel and the front opening, wherein the top panel, the bottom panel, the first chamfer panel, and the second chamfer panel define the front opening, wherein, when the package assembly is disposed in a densely packed array of similar package assemblies, the first chamfer panel is viewable from a first direction facing the first side panel, a second direction facing the front opening, and any direction in between the first direction and the second direction.

2. The package assembly of claim 1, wherein the top panel comprises a three dimensional top portion having a front face, wherein the bottom panel comprises a three dimensional bottom portion having a front face, wherein the first side panel and the first chamfer panel define a three dimensional first side portion, wherein the second side panel and the second chamfer panel define a three dimensional second side portion, and wherein the front face of the top panel, the front face of the bottom panel, the first chamfer panel, and the second chamfer panel define the front opening.

3. The package assembly of claim 1, wherein the inner portion comprises:

a base portion; and a cover portion configured to attach to the base portion, wherein the base portion and cover portion encapsulate the product.

4. The package assembly of claim 3, wherein the cover portion is a substantially transparent plastic material that provides a clear view of a product contained therein.

5. The package assembly of claim 3, wherein the base portion comprises recyclable pulp material molded into a desired three-dimensional shape to accommodate a product.

6. The package assembly of claim 3, wherein the base portion comprises a thin layer surrounding a hollow cavity.

7. The package assembly of claim 6, further comprising a set of product components disposed in the hollow cavity of the base portion.

8. The package assembly of claim 2, wherein the bottom portion defines a hollow volume configured to receive a set of product components.

9. The package assembly of claim 2, wherein the inner portion comprises at least one flange disposed on a side of a perimeter of a bottom region of the inner portion.

10. The package assembly of claim 9, wherein the at least one flange is disposed behind and engaged with at least one of the three dimensional top portion, the three dimensional bottom portion, the three dimensional first side portion, and the three dimensional second side portion, such that the inner portion is restrained from removal through the front opening.

11. The package assembly of claim 10, wherein the at least one flange comprises a first flange disposed behind and engaged with the three dimensional top portion, a second flange disposed behind and engaged with the three dimensional bottom portion, a third flange disposed behind and engaged with the three dimensional first side portion, and a fourth flange disposed behind and engaged with the three dimensional second side portion.

12. A package assembly for displaying a product comprising:

a window frame portion comprising a material adapted to fold into a three dimensional configuration and maintain the three dimensional configuration, the window frame portion including a set of window frame members comprising:

a hollow three dimensional top portion, a hollow three dimensional bottom portion, and a hollow three dimensional first side portion, a hollow three dimensional second side portion; and an inner portion disposed inside a window region defined by the three dimensional window frame members and configured to encapsulate a product, wherein the first side portion comprises a first side panel and a first chamfer panel, wherein the second side portion comprises a second side panel and a second chamfer panel, wherein the inner portion includes a first flange that is coupled to the first side portion and a second flange that is coupled to the second side portion, wherein the product is viewable when housed inside the window region, and wherein the inner portion is restrained from removal from the housing portion by the coupling of the first flange to the first side portion and the second flange to the second side portion, and wherein, when the package assembly is disposed in a densely packed array of similar package assemblies, the first chamfer panel is viewable from a first direction facing the first side panel, a second direction facing the window region and any direction in between the first direction and the second direction.

13. The package assembly of claim 12, wherein the inner portion comprises:

a base portion; and a cover portion configured to attach to the base portion, wherein the base portion and cover portion encapsulate the product.

14. The package assembly of claim 13, wherein the cover portion is a substantially transparent plastic material that provides a clear view of the product contained therein.

15. The package assembly of claim 13, wherein the base portion comprises a thin layer surrounding a hollow cavity, and wherein the base portion is configured to enclose a set of product components disposed in the hollow cavity of the base portion.

16. The package assembly of claim 12, wherein the top portion comprises a top panel, wherein the bottom portion comprises a bottom panel, wherein the top panel displays a first set of information that is similar to or the same as a second set of information displayed on the bottom panel, and wherein the first chamfer panel displays a third set of information that is similar to or the same as a fourth set of information displayed on the second chamfer panel.

17. The package assembly of claim 12, wherein the window frame portion comprises a corrugated material.

18. A window frame housing for housing a product insert comprising:

a hollow three dimensional top portion;

a hollow three dimensional bottom portion;

a hollow three dimensional first side portion, and a hollow three dimensional second side portion, wherein the window frame housing defines a three dimensional window region configured to receive the product insert, wherein the first side portion and the second side portion are configured to couple to flanges on the product insert, wherein the first side portion comprises a first side panel and a first chamfer panel and the second side portion comprises a second side panel and a second chamfer panel, wherein the first chamfer panel comprises first information thereon and is configured to display said first information to a viewer when the viewer is in front of the window frame housing or is viewing the window frame housing from a first direction facing the first side panel, and wherein the second chamfer panel comprises second information thereon and is configured to display said second information to a viewer when the viewer is in front of the window frame housing or is viewing the window frame housing from a second direction facing the second side panel.

19. The window frame housing of claim 18, wherein the product insert comprises:

a base portion; and a cover portion configured to attach to the base portion, wherein the base portion and cover portion are configured to encapsulate a product, and wherein the cover portion is a substantially transparent plastic material that provides a clear view of a product contained therein.

20. The window frame housing of claim 18, wherein the window frame housing comprises a unitary object, which, in a precursor state, has an initial substantially flat cross-type shape that comprises:

a central portion having four sides that form a substantially rectangular shape, wherein the central portion is configured to form a back portion of the window frame housing when fully assembled;

the first side portion and the second side portion being arranged on one side and another side, respectively, of a first pair of opposite sides of the central portion, wherein the first side portion and the second side portion are substantially similar to one another;

the top portion and the bottom portion being arranged on one side and another side, respectively, of a second pair of opposite sides of the central portion;

wherein the first side portion and the second side portion each comprises:

a side panel configured to assemble into an orientation that is substantially orthogonal to the central portion;

a chamfer panel adjacent to the side panel and configured to assemble into an orientation that forms an angle of about thirty to sixty degrees with respect to the side panel;

an inner wall panel adjacent to the chamfer panel and configured to assemble into an orientation substantially parallel to the side panel, such that the inner wall panel extends from a front of the assembled housing toward the central portion, wherein the inner wall panel, the chamfer panel, and the side panel define its respective first side portion and second side portion of the window frame housing;

a back panel adjacent to the inner wall panel and configured to assemble into a position facing the central portion, with its outer edge extended toward the side panel so as to hide the back panel;

a corner flap configured to fold parallel to the top and bottom of the assembled housing so that the corner flap is orthogonal to the assembled side panel and chamfer panel;

a cutout flap forming part of the inner wall panel in the precursor state and being attached to the chamfer panel along a first edge, wherein, in an assembled state, the cutout flap is configured to detach along a cutout surface from the rest of the inner wall panel, such that the cutout flap extends parallel to a front surface of the housing;

wherein the bottom portion comprises:

a bottom panel configured to fold into an assembled state that is substantially perpendicular to the central portion, wherein the bottom panel includes side, angled, and front edges that define a first angle formed between side panels and chamfer panels in the assembled state, and a second angle formed between the chamfer panels and front panel;

a pair of flaps, which, in the assembled state, are each configured to fold inwardly inside a bottom portion of a respective chamfer panel of the first and second side portions;

a lower front panel that is configured to fold into an assembled position in which the bottom panel is substantially orthogonal to the lower front panel;

a lower inner portion that is disposed adjacent to the lower front panel and is configured to fold inwardly in an assembled state so as to extend from the front panel toward the central portion for a first distance, wherein the lower inner portion is substantially orthogonal to the lower front panel, wherein the first distance is less than or about equal to a distance across the bottom panel from the front panel to the central portion;

a pair of side support flaps arranged on opposite sides of the lower inner portion and configured to fold against an inner wall of a side portion in an assembled state; and a lower back flap that is configured to fold downwardly against a bottom region of the back portion;

wherein the top portion comprises:

a top panel configured to fold into an assembled state that is substantially perpendicular to the central portion, wherein the top panel includes side, angled, and front edges that define the first angle formed between side panels and chamfers in the assembled state, and the second angle formed between the chamfer and front panels;

a pair of flaps, which, in the assembled state, are each configured to fold inwardly inside a top portion of a respective chamfer panel of the first and second side portions;

an upper front panel that is configured to fold into an assembled position in which the top panel is substantially orthogonal to the upper front panel;

an upper inner portion that is disposed adjacent to the upper front panel and is configured to fold inwardly in an assembled state so as to extend from the upper front panel toward the central portion for a second distance, wherein the upper inner portion is substantially orthogonal to the upper front panel;

an upper back flap that is configured to fold upwardly so as to face an upper region of the central portion;

wherein, in a partially assembled state, the window frame housing is configured to accommodate flanges of a product insert underneath back panels of the assembled side portions, and wherein the product insert is configured to slide into the partially assembled housing frame at the top portion, before the top portion is assembled, by arranging a base of the insert to be substantially parallel to the central portion, and by positioning the flanges substantially parallel to the central portion.

* * * * *